US007740106B2

(12) United States Patent
Vetesnik

(10) Patent No.: US 7,740,106 B2
(45) Date of Patent: Jun. 22, 2010

(54) MOBILE MOUNT FOR ATTACHMENT OF A FALL ARREST SYSTEM

(75) Inventor: Jan Vetesnik, Winnipeg (CA)

(73) Assignee: Capital Safety Group Winnipeg Ltd., Winnipeg, Manitoba (CA)

( * ) Notice: Subject to any disclaimer, the term of this patent is extended or adjusted under 35 U.S.C. 154(b) by 168 days.

(21) Appl. No.: 10/841,838

(22) Filed: May 10, 2004

(65) Prior Publication Data

US 2005/0247517 A1 Nov. 10, 2005

(51) Int. Cl.
*E06C 5/04* (2006.01)

(52) U.S. Cl. ..... 182/141; 182/180.2; 182/63.1; 182/69.4; 182/116

(58) Field of Classification Search ..... 182/3, 182/13–17, 36, 39, 63.1, 64.1, 115, 127, 182/141, 40, 63, 102, 113, 116, 142, 10, 182/12, 38, 69.4, 180.2; 211/94.01, 162, 211/1.57; 108/144.11, 147.19, 149; 52/651.1
See application file for complete search history.

(56) References Cited

U.S. PATENT DOCUMENTS

| | | | | | |
|---|---|---|---|---|---|
| 476,607 | A | | 6/1892 | Caldwell | |
| 670,548 | A | * | 3/1901 | Sliger | 182/69.4 |
| 1,253,924 | A | | 1/1918 | Barnett | |
| 1,899,162 | A | * | 2/1933 | Lackner | 24/115 R |
| 2,054,281 | A | | 9/1936 | William | |
| 2,565,777 | A | * | 8/1951 | Moon | 52/632 |
| 2,581,176 | A | * | 1/1952 | Dempsey | 182/143 |
| 2,614,744 | A | | 10/1952 | Hedglon | |
| 2,656,088 | A | | 10/1953 | White | |
| 2,693,386 | A | * | 11/1954 | Renfroe | 294/92 |
| 2,871,915 | A | * | 2/1959 | Hogan | 482/69 |
| 2,916,034 | A | * | 12/1959 | Detwiler | 602/4 |
| 2,957,542 | A | | 10/1960 | Rizzuto | |
| 2,961,060 | A | * | 11/1960 | Taylor | 182/40 |
| 3,022,855 | A | * | 2/1962 | Lewis | 182/3 |
| 3,077,178 | A | | 2/1963 | Gordon | |
| 3,151,693 | A | | 10/1964 | Chapman | |
| 3,232,377 | A | * | 2/1966 | Smith | 182/115 |
| 3,327,810 | A | * | 6/1967 | Johnson et al. | 182/17 |
| 3,378,101 | A | * | 4/1968 | Zeitler | 182/16 |
| 3,451,504 | A | * | 6/1969 | Logan | 182/1 |

(Continued)

OTHER PUBLICATIONS

Occupational Safety & Health Administration (OSHA) Standards; Section 1926.502(d)(14).*
"Regulations for Fall Protection Systems Criteria and Practices-1926.502"; US Department of Labor, OSHA; pp. 1-18.*

*Primary Examiner*—Katherine W Mitchell
*Assistant Examiner*—Colleen M Quinn
(74) *Attorney, Agent, or Firm*—IPLM Group, P.A.

(57) ABSTRACT

A mobile mount for attachment of a fall arrest system is provided for example for aircraft and includes a base carried on ground wheels and a support which is adjustable in height upstanding from the base and an arm cantilevered over the base. At least one receptacle is mounted on the arm of the support at a position located over the base for attachment to a personal fall arrest system including a harness for one or more persons, with the receptacle, base and support being designed and arranged to receive a loading from the personal fall arrest system sufficient to accommodate a fall of the person from the elevated structure.

11 Claims, 4 Drawing Sheets

U.S. PATENT DOCUMENTS 3,490,558 A 1/1970 Foley
3,598,200 A 8/1971 Thompson
3,664,458 A * 5/1972 Sterns et al. ..... 182/102
3,752,261 A * 8/1973 Bushnell, Jr. ..... 182/17
3,757,967 A 9/1973 Colbridge
3,760,963 A 9/1973 Welch
3,853,546 A 12/1974 Werner et al.
3,934,918 A 1/1976 Kress et al.
3,997,024 A * 12/1976 Fredricks et al. ..... 182/17
4,004,652 A * 1/1977 Laboy-Alvarado ..... 182/118
4,015,686 A * 4/1977 Bushnell, Jr. ..... 182/148
4,090,399 A 5/1978 Babcock
RE30,072 E 8/1979 Kleine et al.
4,258,825 A * 3/1981 Collins ..... 182/14
4,407,392 A * 10/1983 Lazzari ..... 182/128
4,427,093 A * 1/1984 Wehmeyer et al. ..... 182/141
4,458,785 A * 7/1984 Bushnell, Jr. ..... 187/231
4,529,063 A * 7/1985 Kishi ..... 187/244
4,618,029 A * 10/1986 Lowry ..... 182/116
4,660,679 A 4/1987 Ostrobrod
4,705,140 A * 11/1987 Dudley et al. ..... 182/3
4,709,782 A * 12/1987 Lipinski ..... 182/3
4,709,783 A 12/1987 Tomioka et al.
4,798,262 A 1/1989 Margolies
4,875,547 A 10/1989 Hanthorn
4,987,976 A * 1/1991 Daugherty ..... 187/243
5,036,949 A * 8/1991 Crocker et al. ..... 182/3
5,103,755 A 4/1992 Garrett
5,105,913 A * 4/1992 Neubauer et al. ..... 187/243
5,111,907 A * 5/1992 Kishi ..... 182/69.4
5,143,170 A * 9/1992 Hunt et al. ..... 182/3
5,156,233 A * 10/1992 Olsen et al. ..... 182/3
5,199,688 A 4/1993 Engel
5,295,555 A * 3/1994 Strange ..... 182/2.5
5,295,557 A * 3/1994 Taylor ..... 182/222
5,350,037 A * 9/1994 Ghahremani ..... 182/3
5,411,111 A * 5/1995 Greve ..... 182/17
5,474,151 A * 12/1995 Yonahara ..... 182/152
5,492,067 A * 2/1996 Anderson ..... 105/163.2
5,503,358 A 4/1996 Lapp
5,522,472 A * 6/1996 Shuman et al. ..... 182/3
5,555,953 A 9/1996 Henderson
5,564,523 A * 10/1996 Howard ..... 182/63.1
5,575,220 A * 11/1996 van Soest et al. ..... 105/163.1
5,622,237 A 4/1997 Moldow
6,148,580 A * 11/2000 Weir ..... 52/651.1
6,170,802 B1 1/2001 Stovall
6,269,904 B1 * 8/2001 Morhaus ..... 182/36
6,408,587 B2 * 6/2002 Cronin et al. ..... 52/637
6,467,576 B2 * 10/2002 Figura et al. ..... 182/63.1
6,571,398 B2 6/2003 Stahl et al.
6,575,100 B2 * 6/2003 Faucher et al. ..... 104/126
6,823,964 B2 * 11/2004 Goode ..... 182/3
6,830,423 B1 12/2004 Williams et al.
7,032,710 B2 4/2006 Anderson et al.
7,255,198 B1 8/2007 Lo
7,363,875 B2 4/2008 Vetesnik
2005/0274572 A1 * 12/2005 Stelzer ..... 182/36

* cited by examiner

MOBILE MOUNT FOR ATTACHMENT OF A FALL ARREST SYSTEM

The present invention relates a mobile mount for attachment of a fall arrest system.

BACKGROUND OF THE INVENTION

Fall protection of operators working in a situation where a fall can take place over a sufficient distance to cause injury or death is becoming generally required in most industries. Many arrangements are provided for mounting an anchor post on a structure adjacent the worker so that a personal fall arrest system can be attached to the anchor.

Such personal fall arrests systems include a harness together with a cable system for attachment to the harness and to a suitable anchor where the cable system can be paid out to allow the worker to move to a required location but the cable system arrests any fall within a short distance. Such devices are well known and commercially available and many different designs have been proposed.

In most cases the structure itself provides or has attached a suitable anchoring post so that the relatively high loading necessary can be readily provided by a simple post rigidly attached to the structure.

In the interior buildings, such anchors can be mounted on a rail which allows the anchor to slide longitudinally along a track attached to the rail.

However some structures are unsuitable for attachment of an anchor post or have been designed without the possibility of attachment of an anchor post so that operators in this environment are often unprotected against fall. In a particular area where this is problematic is in that related to aircraft where aircraft design does not lead to the suitability of attachment of mounting posts. Up until now, therefore, operators working in this environment have remained unprotected with the potential of serious injury or death.

SUMMARY OF THE INVENTION

According to a first aspect of the invention there is provided an apparatus comprising:

a base carried on ground wheels for movement over a ground surface to an elevated structure on which one or more persons is intended to work;

a support upstanding from the base having an upstanding support portion extending from the base to an elevated position above the base and an arm assembly extending from the upstanding support portion to a position cantilevered over the base;

the upstanding support portion being adjustable in height from the base;

and at least one receptacle mounted on the arm assembly of the support at a position located over the base for attachment to a personal fall arrest system including a harness for said one or more persons;

the receptacle, base and support being designed and arranged to receive a loading from the personal fall arrest system sufficient to accommodate a fall of the person from the elevated structure.

Preferably there are at least two receptacles carried on the arm assembly each for receiving the personal fall arrest system of a respective one of two separate persons.

Preferably the or each receptacle is mounted so as to allow side to side movement of the receptacle relative to the base.

Preferably the base includes a hitch by which the base can be moved to the elevated structure by a towing vehicle.

Preferably there is provided a ladder carried on the support for the person to ascend to the elevated structure from the ground, which ladder can extend with the extension of the upstanding support portion.

Preferably there is provided a platform at a top of the ladder extending from the top of the ladder outwardly over the base.

Preferably the support arm assembly is arranged such that the at least one receptacle is cantilevered generally over a mid line of the base.

In one arrangement, the or each receptacle is carried on a rail mounted on the support arm assembly so as to extend along midline of base.

Preferably the or each receptacle is designed to receive a load of at least 1800 pounds.

Preferably there are two receptacles and the support arm assembly carrying the two receptacles is arranged to support a load of at least 2000 pounds.

Preferably the or each receptacle comprises a loop for receiving a hook of the personal fall arrest system.

Preferably the upstanding support portion is arranged along one side of the base and the support arm assembly extends from the upstanding support portion so as to be cantilevered therefrom across the base.

In one arrangement, the upstanding support portion comprises a pair of posts spaced apart along the side of the base.

Preferably the upstanding support portion includes a cross rail between the posts.

In one arrangement, there is provided a ladder between the posts for the person to ascend to the elevated structure from the ground.

In one arrangement, the upstanding support portion includes a ladder with side rails and transverse rungs for the person to ascend to the elevated structure from the ground and wherein there is a post attached to an upper end of each side rail with the at least one receptacle mounted on a top of at least one of the posts.

Preferably the post is inclined forwardly of an upper end of the side rail to cantilever the receptacle in front of the ladder.

Preferably there is provided a platform between rails at the top of the ladder for the person to step onto the elevated structure.

In another arrangement, there are two ladders each including side rails and transverse rungs for the person to ascend to the elevated structure from the ground and wherein there is a post attached to an upper end of each side rail with a transverse beam extending between the ladders and carrying the at least one receptacle.

BRIEF DESCRIPTION OF THE DRAWINGS

On embodiment of the invention will now be described in conjunction with the accompanying drawings in which.

DETAILED DESCRIPTION

Figure 1:
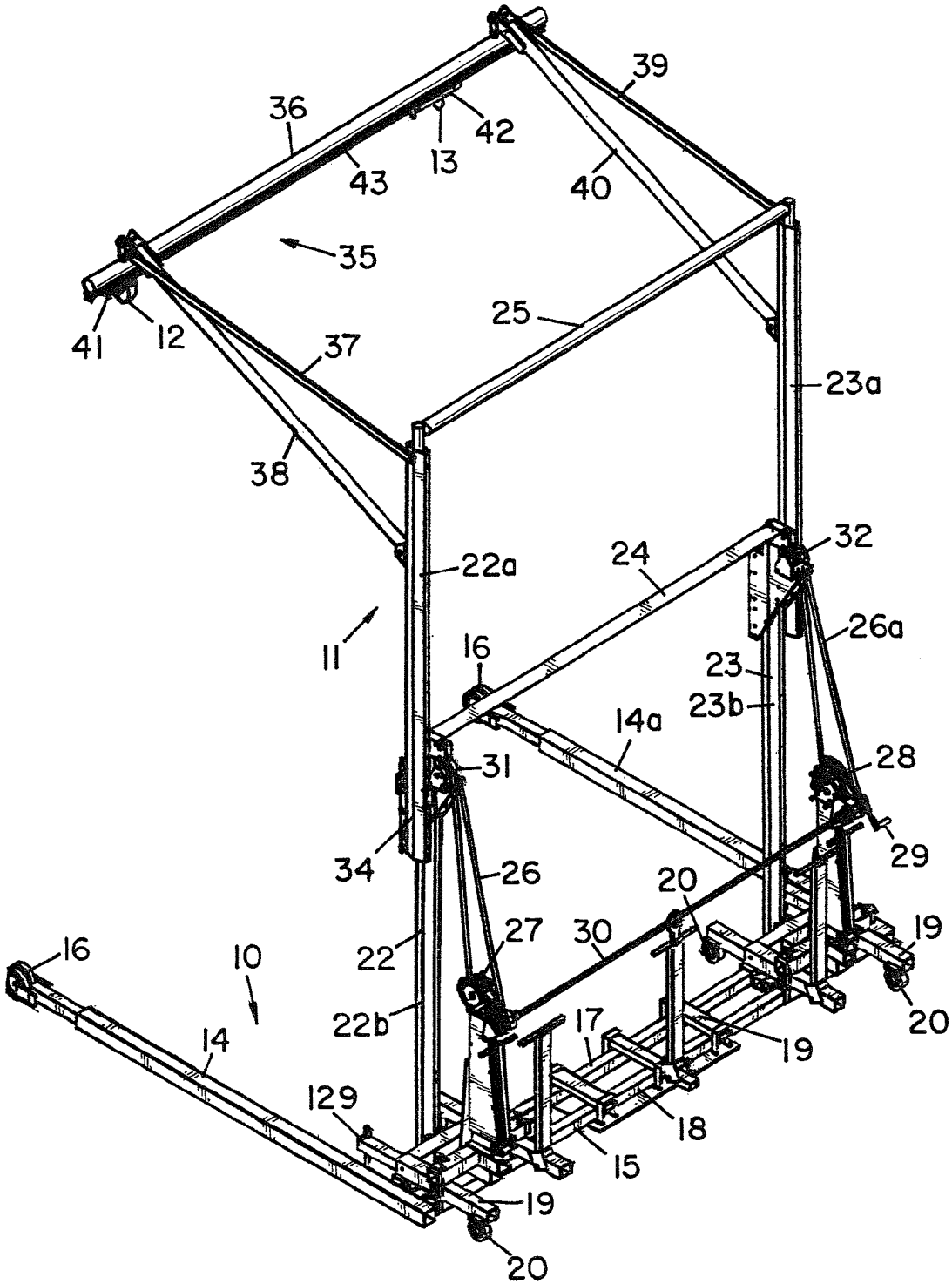
FIG. 1 is an isometric view of the first embodiment according to the present invention.

In FIG. 1 is shown a first embodiment according to the present invention which includes a base 10 and a support 11 for supporting anchors or receptacles 12 and 13 at a raised position above the base.

The base comprises a pair of side rails 14 and 14A extending forwarding from a rear frame structure 15. At the outer end of each side rail is provided a ground engaging wheel 16 for rolling over the ground supporting the base.

The rear frame structure 15 comprises a pair of rails 17 and 18 which are parallel and generally at right angles to the side rails 14 and 14A. The rails 17 and 18 are parallel and interconnected by a number of cross members 19 which hold the rails parallel. The rails 14 and 14A are attached to respective ends of the rails 17 and 18 so as to form a rigid structure. Some of the cross members 19 extend outwardly beyond the rails 17 and 18 and provide a support for a ground wheel 20 which co-operates with a ground wheel 16 in supporting the base for movement across the ground. The number of ground wheels and arrangement of ground wheels depends upon the weight to be supported and the type of ground wheel to be used. The base provides a relatively wide area for support over the ground to prevent toppling of the structure when load is applied. Further, some of the cross members 19 extend inward of frame 15 between side rails 14 and 14A and provide a support for stabilizing legs 129. Stabilizing legs 129 can be moved down into engagement with the ground so as to transfer some loading from the base from the ground wheels 20 to the stabilizing legs 129 to maintain the base 10 at a required location. As illustrated in this embodiment, at least one stabilizing leg 129 is located between the side rails 14 and 14A and within an area defined by the base 10. Moreover as illustrated, at least one cross member 19 has opposed ends that extends beyond a width of the rear framed structure 15 with a first end of the cross member 19 extending forward of the rear framed structure 15 and a second end extending rearward of the rear framed structure 15. As further illustrated, a ground wheel 20 is mounted proximate the second end of this cross member 19 and a stabilizing leg 129 coupled proximate the first end of this same cross member 20.

At opposite ends of the frame 15 is provided a pair of upstanding posts 22 and 23 which form a part of the support 11. The upstanding posts are formed in two sections including upper portions 22A and 23A which are slidable vertically relative to the lower portions 22B and 23B. Suitable mounting using bearings can be provided between the portions to allow the vertical sliding movement required to elevate the upper section relative to the lower section. A cross member 24 connects the upper end of the lower portions 22B and 23B to retain the structure rigid. A similar cross member 25 is provided across the top of the upper portions 22A and 23A to maintain the upper section rigid. The upper section is raised relative to the lower section by chains 26 and 26A carried on lower pulleys 27 and 28, respectively, operated by manually rotatable handle 29 attached to a shaft 30. The shaft 30 extends between the two pulleys 27 and 28 so the rotation of the handle 29 pulls the chains 26 and 26A over an upper pulley 31, 32 respectively at the top of the respective posts portions 22B and 23B so as to pull on the lower end of the upper portions 22A and 23A pulling them upwardly along the slide mounting indicated at 34.

Thus the upright portion of the support 11 defined by the posts and the cross members can be raised and lowered to a required height. At the top of the upper portion of the posts is provided a cantilever arm section generally indicated at 35 forming part of the support 11. The cantilever arm structure comprises a rail 36 parallel to the cross beams 25 and 24 and cantilevered outwardly therefrom on support rails 37, 38, 39 and 40. The rails 38 and 40 form a brace at an angle to the rails 37 and 39 thus maintaining the rail 36 at a position approximately midway across the base from the frame 15 towards the wheels 16.

The rail 36 is formed by a structural tube together with a transport track attached to the underside of the structural tube so the track carries a pair of trolleys 41 and 42 which can slide along the track 43 independently of one another. Each trolley carries a respective one of the anchors 12, 13.

Thus the operator shown in FIG. 1 can be wheeled to a required location at an elevated structure with the rail 36 supported at a position above the elevated structure by any necessary adjustment of the height of the support. The location of the rail 36 over the elevated structure can be obtained by moving the base on the wheels to the required position relative to the elevated structure. The arrangement as shown is particularly suitable for location over the wing of an aircraft with the rail 36 at a position approximately head height above the operator standing on the wing. Thus the base is located under the wing with the rail 36 above the wing.

The structure is designed and arranged to provide sufficient loading so that the anchors can receive the full force obtained by an operator falling from the elevated structure.

In practice it has been determined that the necessary loading which the anchor must accommodate is of the order of 1800 lbs. for a single operator and either 2000 lbs. or 3000 lbs. for two operators depending upon the jurisdiction where the standards are in force. Thus the anchor is not merely an anchor location but must provide sufficient strength so that the fall of a heavy operator potentially carrying heavy equipment and the impact of that fall on the personal fall arrest system can be applied to the anchor and through the anchor to the ground without damaging the structure or allowing the operator to fall beyond the intended position arrested by the fall arrest system.

Figure 2:
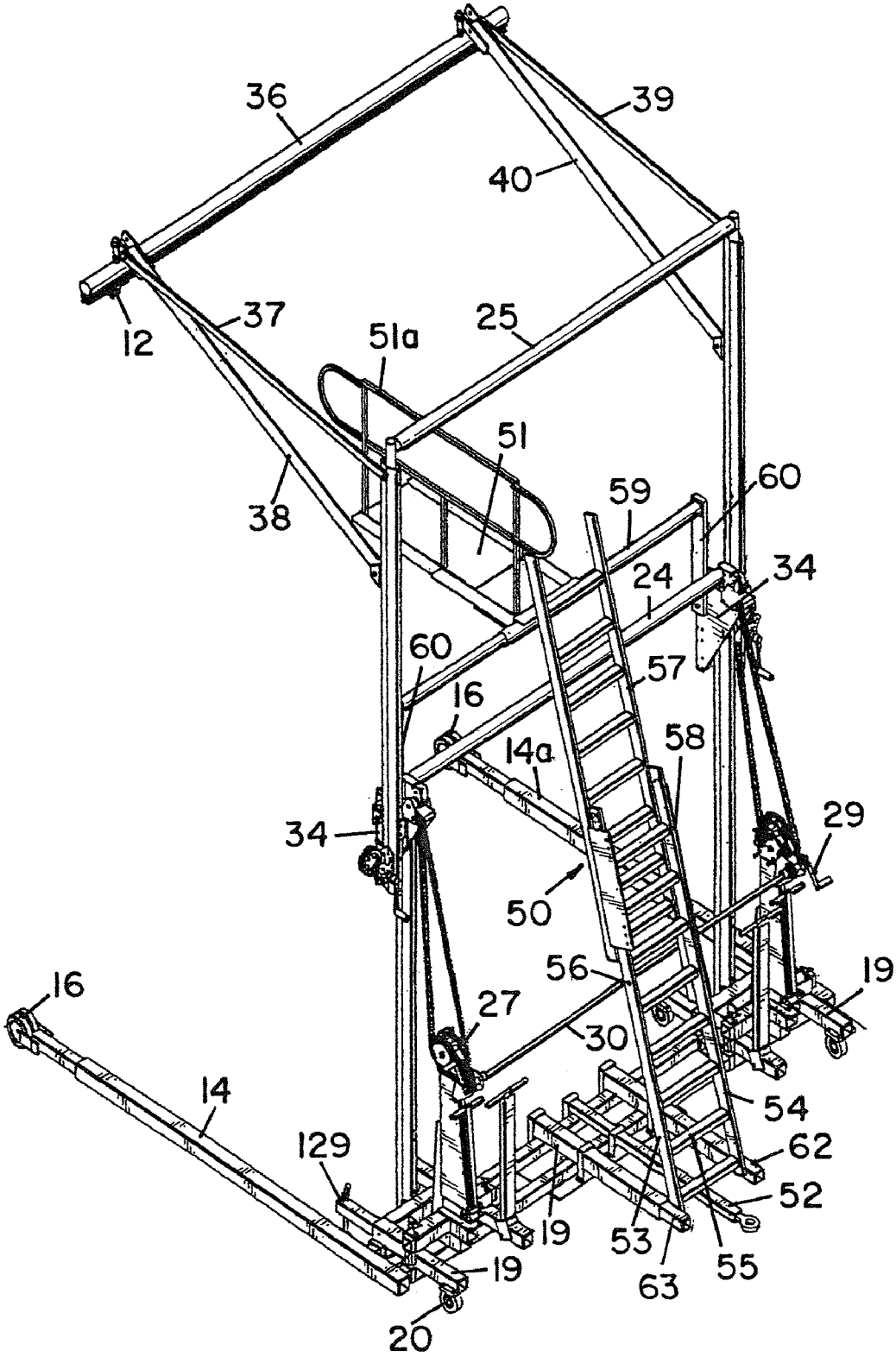
FIG. 2 is an isometric view of the embodiment of FIG. 1 modified to incorporate a ladder and platform by which the operator can raise to the elevated structure.

Turning now to FIG. 2, there is shown exactly the same structure as shown in FIG. 1 together with the additional elements of a ladder 50, a platform 51 and a hitch 52. The ladder 50 comprises side rails 53 and 54 together with transverse rungs 55. The ladder is formed of a lower section 56 and an upper section 57 which can extend at its lower section 56 by sliding along side rails at a coupling 58. The upper end of the ladder is mounted on a cross beam 59 attached to the slides 34 by posts 60. Thus the upper end of the ladder is attached to the upper part of the frame for elevation therewith so that elevation of the other part of the frame obtained by the operator rotating the handle 29 automatically acts to lift the upper end of the ladder relative to the lower end of the ladder. The lower end of the ladder is attached to a pair of extension pieces 62 and 63 which extend outwardly from respective ones of the cross members 19 of the frame 15. Such cross members can be formed from a tube so that the lower part of the ladder includes a smaller tube inserted into the outer tube of the cross member 19 for readily attaching the ladder to the structure.

Thus the lower end of the ladder is fixed and the upper extends with the support to the required height to allow the operator to climb the ladder to the required location. At the top of the ladder is provided the platform 51 which is cantilevered out from the rail 59 and may be supported by braces from the rail 25. The platform provides a horizontal surface onto which the operator can step to transfer from the ladder to the horizontal surface and from the horizontal surface onto the structure to be worked upon. Alternatively the operator may remain on the platform to carry out the work while protected from falling by the fall restraint system provided by the anchors 12 and 13. Hand rail 51A can supplement the platform to allow the operator to stand while supported.

Figure 3:
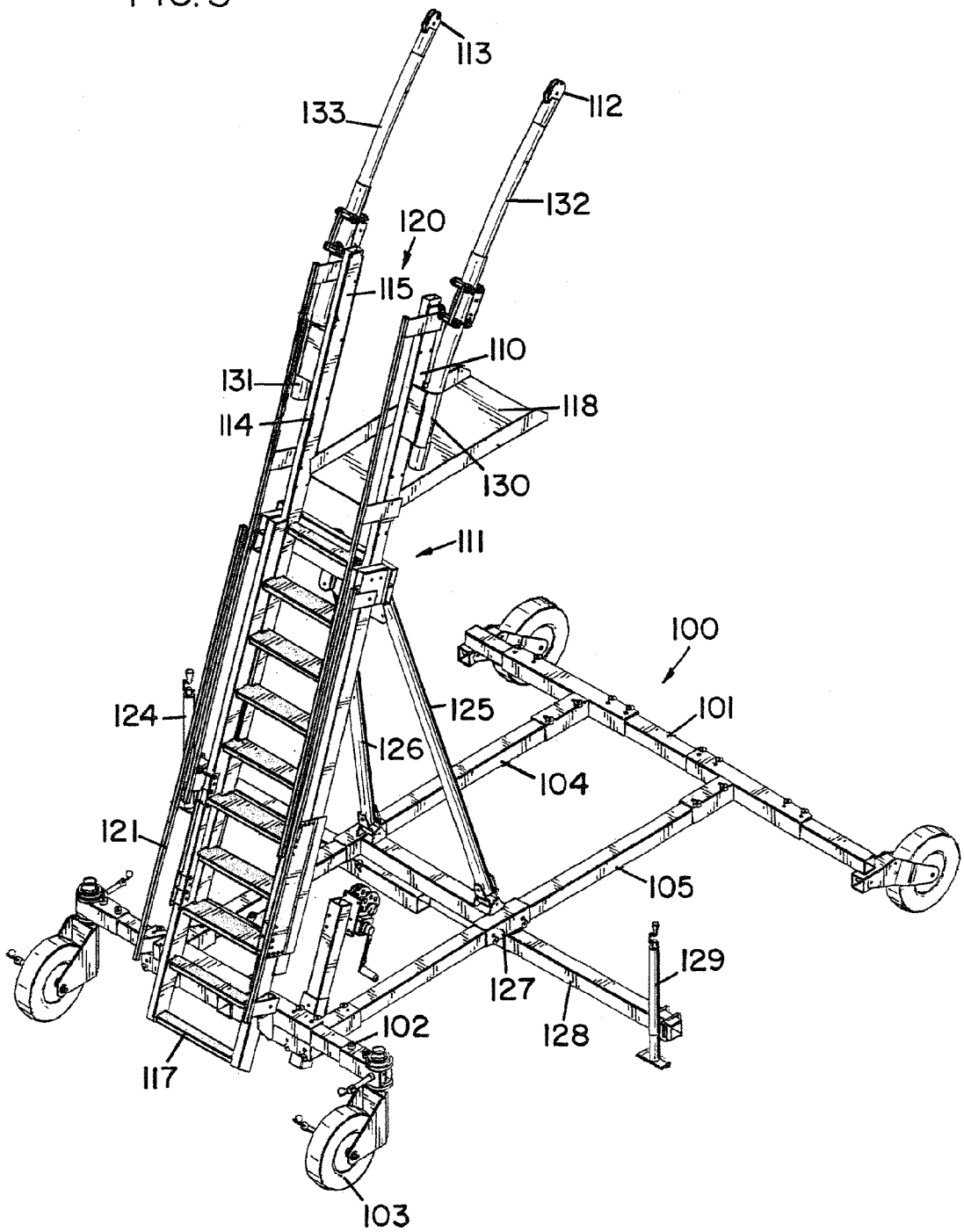
FIG. 3 is an isometric view of a second embodiment according to the present invention.

Turning now to FIG. 3, an alternative embodiment is shown including a base 100 and a support 111 for anchors 112 and 113. In this embodiment the base 100 is formed by cross beams 101 and 102 carrying ground wheels 103 together with longitudinal beams 104 and 105. The wheels are suitable castor wheels or may alternatively be driven wheels for moving the base by powered operation.

In this embodiment the support 111 is in the form of a ladder structure 114 with side rails 115 and 116 together with transverse rungs 117 and an upper platform 118. The ladder structure is again formed in two pieces with an upper part 120 which can be raised relative to a lower part 121 by actuation of a manually operable chain lifting system 124. Thus the upper parts of the rails of the ladder can slide upwardly to raise the platform 118 and the anchors 112 and 113 to a required height above an elevated structure to operated on. The lower part of the ladder is rigidly attached to the cross beam 103 and is supported by braces 125 and 126 extending downwardly to the longitudinal rails 104 and 105. The lower end of the braces is attached to slide members 127 which can move longitudinally along the respective rails 104, 105 and carry a cross beam 128 which has stabilizing legs 129 at each end. Stabilizing legs can be moved down into engagement with the ground so as to transfer some loading from the base from the wheels to the legs to maintain the base at a required location.

At the upper end of the rails 115 and 116 of the ladder is provided a tubular receptacle 130, 131 for a curved post 132 and 133 respectively which extends upwardly from the receptacle and forwardly beyond the end of the upper part of the ladder to the upper anchor 112, 113 respectively. Thus the anchors are cantilevered forwardly beyond the end of the ladder by the curvature of the posts 132 and 133. Thus again the anchors 112 and 113 are located approximately over the midline of the base and a cantilevered over structure with the base located underneath the structure. Again this arrangement is particularly suitable for the wing of an aircraft where the base can be moved to a position beneath the wing with the platform moved up to the end of the wing and the anchors 112 and 113 located over the wing for the operator to transfer from the platform onto the wing for operations on the aircraft.

Figure 4:
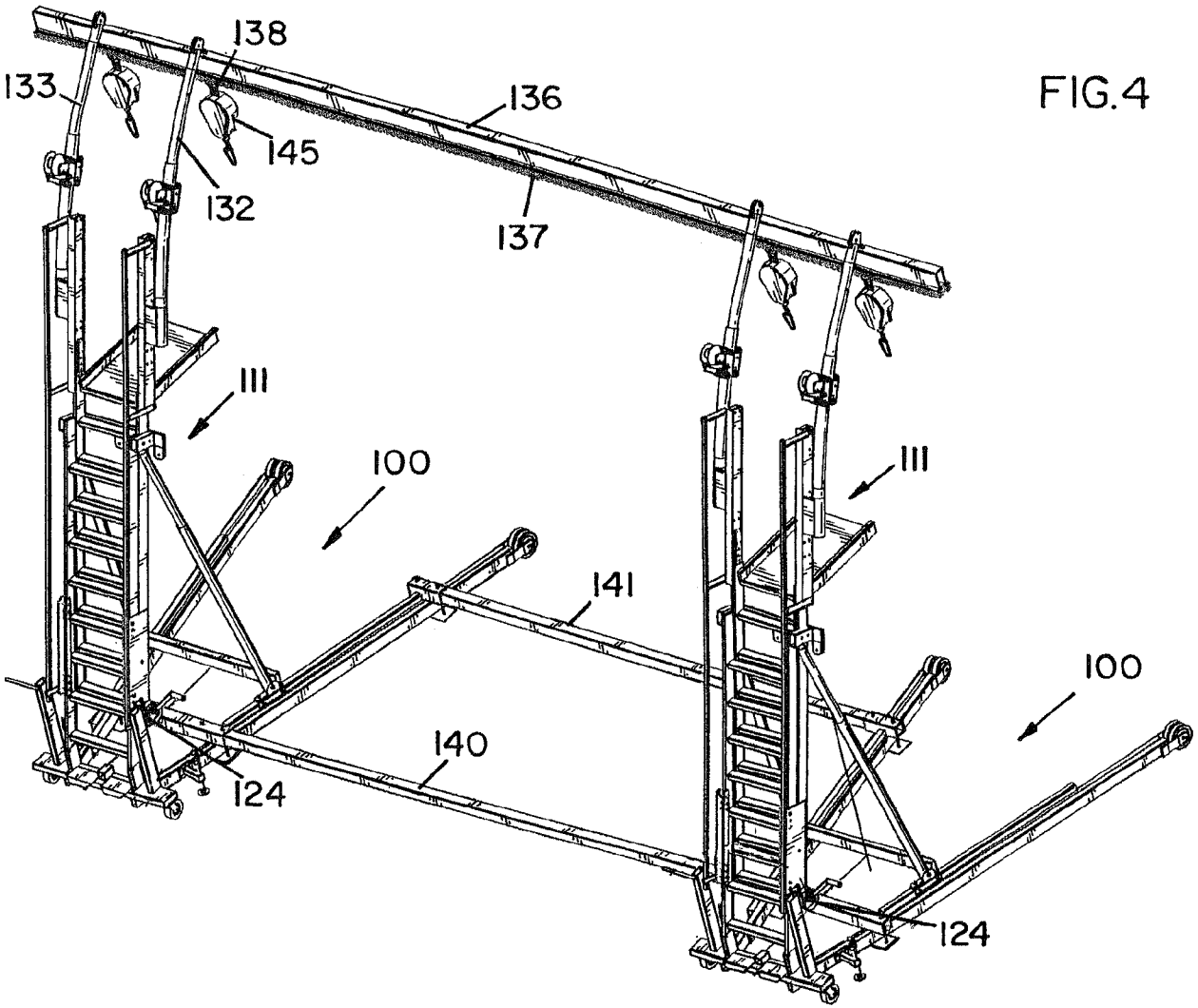
FIG. 4 is an isometric view of a modified version of the embodiment of FIG. 3 incorporating two of the components of FIG. 3 connected together.

In FIG. 4 is shown an alternative arrangement which utilizes basically the structure of FIG. 3 arranged in a pair of such structures connected together by cross members 140 and 141. Thus each base 100 and each support 111 is provided at a position spaced transversely of the base frames and connected together at spaced positions by the rails 140 and 141. At the top of the post 132 and 133 is provided a transverse rail 136 similar to the rail 36 which carries a track 137 and trolleys 138. Each trolley is attached to a personal safety arrest system generally indicated at 145. Thus the basic system shown in FIG. 3 can be modified to provide an elongated structure to provide an elongated protection system along the full extent of the rail 136 which may be up to 30 feet in length so that a number of operators can be properly protected by personal fall arrest systems slidable along the rail 136 in its track 137. The rail 136 can be removed from the posts 132 and 133 and the base 100 can be separated to provide two separate elements which can be used independently. The base structure in FIG. 4 is slightly different in construction from that shown in FIG. 3 in that the side rails extend at an angle outwardly and the wheels are attached to the ends of the side rails rather than to the ends of the cross rail 101 as shown in FIG. 3. It will be appreciated that different forms of base structure be designed with the intention that the structure merely provides sufficient ground engagement area to accommodate any side loads which occur as an operator falls to prevent the system from toppling and to maintain the rail 136 at its elevated position despite any direction of fall of one or more operators from the elevated structure.

The structure shown in FIG. 1 can also be extended by providing additional posts and increasing the length of the rails 24, 25 and 36. Thus for example the basic rail 36 may be of the order of 20 ft. which should be increased to 30 ft. by providing an additional post to provide three such posts in a row.

Since various modifications can be made in my invention as herein above described, and many apparently widely different embodiments of same made within the spirit and scope of the Claims without department from such spirit and scope, it is intended that all matter contained in the accompanying specification shall be interpreted as illustrative only and not in a limiting sense.

The invention claimed is:

1. A mobile mount for attachment of a fall arrest system, comprising:

a base carried on ground wheels for movement over a ground surface to an elevated structure on which one or more persons is intended to work, the elevated structure being separate from the base;

the base comprising a rear transverse frame extending across the base and a pair of side rails extending forwardly from the rear frame;

the ground wheels including a pair of rear wheels mounted on the transverse rear frame and a pair of front wheels each mounted on a respective one of the side rails;

at least one stabilizing leg positioned between the pair of rear wheels and the pair of front wheels, the at least one stabilizing leg further positioned between the pair of side rails, the at least one stabilizing leg configured to selectively engage the ground surface to transfer some loading away from the pair of rear wheels and the pair of front wheels;

a plurality of cross members, each cross member coupled across the rear transverse frame, at least one cross member having a length that extends beyond a width of the rear transverse frame such that a first end of the at least one cross member extends forward of the rear transverse frame and a second end of the at least one cross member extends rearward of the rear transverse frame, at least one rear wheel being mounted proximate an end of the at least one cross member, the at least one stabilizing leg mounted proximate the other end of the at least one cross member;

a support upstanding from the rear transverse frame of the base having an upstanding support portion extending from the base to an elevated position above the base and an arm assembly extending from the upstanding support portion to a position cantilevered over the base;

the upstanding support portion including first and second vertical posts at spaced positions across the rear transverse frame and at least one cross beam joining the posts, the first and second vertical posts each including an upper portion and a lower portion vertically slidable relative to one another to be vertically adjustable in height;

the arm assembly including a transverse rail parallel to the at least one cross beam of the posts and spaced forwardly of the posts;

the transverse rail being supported over the side rails by being cantilevered forwardly from the first post by a first arm extending from a top of the first post to the rail and a first brace extending from a position on the first post below the first arm and inclined upwardly to the rail;

the rail being supported over the side rails by being cantilevered forwardly from the second post by a second arm extending from a top of the second post to the rail and a second brace extending from a position on the second post below the second arm and inclined upwardly to the rail;

the rail including a transport track;

at least one trolley slidably engaged with the transport track;

and at least one receptacle mounted on the at least one trolley that is slidably engaged with the transport track of the transverse rail of the arm assembly of the support at a position located over the side rails of the base for attachment to a personal fall arrest system including a harness and a self-retracting lifeline for said one or more persons; and wherein the upper portions of the first and second vertical posts are vertically adjustable relative to the lower portions to position the transverse rail and the at least one receptacle proximate above the elevated structure on which the one or more persons is intended to work, the receptacle, base and support being designed and arranged to receive a loading of 1800 to 3000 pounds from the personal fall arrest system in the event of a fall of the person from the elevated structure.

2. The apparatus according to claim 1 wherein there are at least two receptacles carried on the transverse rail of the arm assembly each for receiving the personal fall arrest system of a respective one of two separate persons.

3. The apparatus according to claim 1 wherein the at least one receptacle is mounted so as to allow side to side sliding movement of the receptacle along the transverse rail relative to the base.

4. The apparatus according to claim 1 wherein the base includes a hitch by which the base can be moved to the elevated structure by a towing vehicle.

5. A mobile mount for attachment of a fall arrest system, comprising:

a base carried on ground wheels for movement over a ground surface to an elevated structure on which one or more persons is intended to work, the elevated structure being separate from the base;

the base comprising a rear transverse frame extending across the base and a pair of side rails extending forwardly from the rear frame;

the ground wheels including a pair of rear wheels mounted on the transverse rear frame and a pair of front wheels each mounted on a respective one of the side rails;

at least one stabilizing leg positioned between the pair of rear wheels and the pair of front wheels, the at least one stabilizing leg configured to selectively engage the ground surface to transfer some loading away from the pair of rear wheels and the pair of front wheels;

a plurality of cross members, each cross member coupled across the rear transverse frame, at least one cross member having a length that extends beyond a width of the rear transverse frame such that a first end of the at least one cross member extends forward of the rear traverse frame and a second end of the at least one cross member extends rearward of the rear traverse frame, at least one rear wheel being mounted proximate an end of the at least one cross member, the at least one stabilizing leg mounted proximate the other end of the at least one cross member;

a support upstanding from rear transverse frame of the base having an upstanding support portion extending from the base to an elevated position above the base and an arm assembly extending from the upstanding support portion to a position cantilevered over the base;

the upstanding support portion including first and second vertical posts at spaced positions across the rear transverse frame and at least one cross beam joining the posts, the first and second vertical posts each including an upper portion and a lower portion vertically slidable relative to one another to be vertically adjustable in height;

the arm assembly including a transverse rail parallel to the at least one cross beam of the posts and spaced forwardly of the posts;

the transverse rail being supported over the side rails by being cantilevered forwardly from the first post by a first arm extending from a top of the first post to the rail and a first brace extending from a position on the first post below the first arm and inclined upwardly to the rail;

the rail being supported over the side rails by being cantilevered forwardly from the second post by a second arm extending from a top of the second post to the rail and a second brace extending from a position on the second post below the second arm and inclined upwardly to the rail;

the rail including a structural tube and a transport track;

at least one trolley slidably engaged with the transport track;

and at least one receptacle mounted on the at least one trolley that is slidably engaged with the transport track of the transverse rail of the arm assembly of the support at a position located over the side rails of the base for attachment to a personal fall arrest system including a harness and a self-retracting lifeline for said one or more persons;

wherein the upper portions of the first and second vertical posts are vertically adjustable relative to the lower portions to position the transverse rail and the at least one receptacle proximate above the elevated structure on which the one or more persons is intended to work, the receptacle, base and support being designed and arranged to receive a loading of 1800 to 3000 pounds from the personal fall arrest system in the event of a fall of the person from the elevated structure; and wherein there is provided an inclined ladder having a lower end carried on extension pieces extending rearwardly from the rear frame of the support and an upper end carried on the cross beam of the posts so that the ladder can extend with the extension of the posts of the upstanding support portion.

6. The apparatus according to claim 5 wherein there is provided a platform at a top of the ladder extending from the top of the ladder forwardly over the base.

7. The apparatus according to claim 1 wherein the support arm assembly is arranged such that the transverse rail is cantilevered generally over a line half way along the side rails of the base.

8. The apparatus according to claim 1 wherein the at least one cross beam further comprises:

a first cross beam interconnecting a first top portion of each of the lower portions of the first and second vertical posts and a second cross beam interconnecting a second top portion of each of the upper portions of the first and second vertical posts.

9. The apparatus according to claim 1 further comprising a first pulley operatively connected to the base, a second pulley operatively connected to a top portion of the lower portion, and a chain interconnecting the first pulley and the second pulley, wherein rotation of the first pulley pulls the chain over the second pulley to pull a bottom portion of the upper portion upward relative to the lower portion thus vertically adjusting the upstanding support.

10. The apparatus according to claim 5 wherein the at one cross beam further comprises:

a first cross beam interconnecting a first top portion of each of the lower portions of the first and second vertical posts and a second cross beam interconnecting a second top portion of each of the upper portions of the first and second vertical posts.

11. The apparatus according to claim 5 further comprising a first pulley operatively connected to the base, a second pulley operatively connected to a top portion of the lower portion, and a chain interconnecting the first pulley and the second pulley, wherein rotation of the first pulley pulls the chain over the second pulley to pull a bottom portion of the upper portion upward relative to the lower portion thus vertically adjusting the upstanding support.

* * * * *

UNITED STATES PATENT AND TRADEMARK OFFICE

CERTIFICATE OF CORRECTION

PATENT NO. : 7,740,106 B2
APPLICATION NO. : 10/841838
DATED : June 22, 2010
INVENTOR(S) : Jan Vetesnik It is certified that error appears in the above-identified patent and that said Letters Patent is hereby corrected as shown below:

Column 2, Line 58:
"On embodiment" should read --One embodiment--.

Claim 10, Column 9, Line 13:
"the at one" should read --the at least one--.

Signed and Sealed this

Sixteenth Day of November, 2010

David J. Kappos

David J. Kappos
*Director of the United States Patent and Trademark Office*